US007617910B2

(12) United States Patent
Karpy

(10) Patent No.: US 7,617,910 B2
(45) Date of Patent: Nov. 17, 2009

(54) SANITARY PLATFORM UTILIZING A WEB BRACKET

(75) Inventor: Daniel P. Karpy, Odessa, FL (US)

(73) Assignee: Arrowhead Conveyor Corporation, Inc., Oshkosh, WI (US)

( * ) Notice: Subject to any disclaimer, the term of this patent is extended or adjusted under 35 U.S.C. 154(b) by 760 days.

(21) Appl. No.: 11/230,428

(22) Filed: Sep. 20, 2005

(65) Prior Publication Data

US 2007/0062129 A1 Mar. 22, 2007

(51) Int. Cl.
*E06C 7/18* (2006.01)

(52) U.S. Cl. ..... 182/115; 182/106; 108/51.11; 52/710

(58) Field of Classification Search ..... 52/702, 52/706, 710, 714, 665, 263, 650.3, 483.1, 52/831, 92.1, 92.2, 92.3, 93.1, 664, 403, 52/666, 668; 108/51.11; 182/106, 115
See application file for complete search history.

(56) References Cited

U.S. PATENT DOCUMENTS 3,796,503 A 3/1974 Dawson
4,926,599 A * 5/1990 Scholz ..... 49/87.1
6,295,781 B1 * 10/2001 Thompson ..... 52/712
6,296,111 B1 10/2001 McKanik
6,871,737 B2 3/2005 Ertel
7,114,904 B2 * 10/2006 Charbonneau et al. ..... 414/276
7,335,096 B2 * 2/2008 Perez et al. ..... 454/358
2005/0081460 A1 * 4/2005 Davis ..... 52/169.9
2006/0040607 A1 * 2/2006 Perez et al. ..... 454/358

* cited by examiner

*Primary Examiner*—Richard E Chilcot, Jr.
*Assistant Examiner*—Alp Akbasli
(74) *Attorney, Agent, or Firm*—Boyle Fredrickson, S.C.

(57) ABSTRACT

This patent pertains to a platform device upon which a person, equipment or both are supported above a ground surface in which the build-up of debris and moisture is impeded. The sanitary platform system is comprised of two or more main rails having square cross-sections that are on diamond and are side-by-side with a space between the main rails; one or more standard web brackets comprised of a plate, two or more tabs and a perimeter defining an opening for receiving a main rail on diamond which are mounted in spaced-apart relation along the length of each of the main rails; two or more vertical legs supporting each of the main rails above the ground surface, and one or more deck plates welded to the tabs of the standard web bracket.

10 Claims, 6 Drawing Sheets

SANITARY PLATFORM UTILIZING A WEB BRACKET

BACKGROUND OF THE INVENTION

1. Field of the Invention

This invention pertains generally to platform devices comprising a surface element upon which a person, equipment or both are supported and more particularly, to platforms in which the build-up of debris and moisture is impeded.

2. Related Art

A platform is a raised deck above a ground surface (e.g., the floor of a building) with open space underneath the deck. The deck is raised by an understructure of horizontal beams and vertical columns. A platform is utilized as a work area and/or to support machinery (e.g., a weighing scale). It is often desirable to have a platform overlying a conveyor that transports articles.

Platforms are used in the food and pharmaceutical industries. When so used, pieces of meat, food, powders and other debris accumulate on the platform; especially, the understructure. The food and pharmaceutical industries require sanitary conditions. The platforms are put through a wash cycle which involves spraying with water or water-based cleaners. The wash cycle is not fully effective in removing debris and sanitizing the platform. Platforms are currently required by law to be Hazardous Analysis of Critical Control Point ("HACCP") compliant and Food and Drug Administration ("FDA") compliant.

The prior art teaches a platform understructure of horizontal beams made out of square tubing which are connected in a perpendicular configuration to vertical columns that are made out of square tubing. This connection is accomplished through flange plates, nuts and bolts and assembly is labor intensive.

The horizontal beams are oriented such that a top (and a bottom) flat side of the square tube is essentially parallel to the ground surface. This orientation for the horizontal beam is called "lying on flat." The horizontal beams which are lying on flat are of limited structural strength and several spaced-apart parallel horizontal beams are needed to support wider platforms or platforms bearing heavier loads. The flat surfaces of the horizontal beams which are parallel to the ground surface are collection surfaces for water and debris and are bacterial growth zones.

There is a stiffener bar extending at a 45 degree angle from a vertical column to a mating horizontal beam. The junction between the stiffener bar and vertical column forms a pocket or region called a dead corner. In this dead corner, debris and water collect and the dead corner is a bacterial growth zone. The stiffener bar is connected to beams and columns by flange plates, nuts and bolts and assembly is labor intensive.

Deck plates are welded to spacer runners affixed to the top of horizontal beams. This welding involves long running welds that span the width and/or length of the deck plate. Such long running welds cause thermal expansion of the deck plates and in turning bowing of the plates. This in turn results in areas where water pools and a bacterial growth zone.

Oftentimes, a deck plate overhangs beyond a spacer runner. In such a case, loads on the deck plate impose a cantilever. This in turn results in a bending of the deck plate to create a slide surface for debris to fall into whatever is under the platform; e.g., a conveyor carrying food or pharmaceutical product.

The platform may be provided with a guard rail at its perimeter. Like the understructure, the guard rail is made out of square tubing with horizontal tubes lying on flat and mating with vertical tubes in a perpendicular configuration. Vertical tubes that extend up to or above the top surface of a horizontal tube terminate in a flat end that is essentially parallel to the ground surface. These flat surfaces that are substantially parallel to the ground are collection surfaces for debris and water and a bacterial growth zone.

The platform system of the prior art is unsatisfactory. Assembly of the platform is labor intensive due to the large number of beams, columns and stiffener bars that need to be assembled and the utilization of nuts and bolts to secure beams, columns and stiffener bars. The long running welds to secure Deck Plates to the spacer runners causes thermal expansion and bending of the Deck Plates. This results in a depression which can collect debris and water from washing and be a growth zone for bacteria.

The sanitation of the platform system of the prior art is unsatisfactory. Small pieces of meat, food, powders and debris (collectively referred to as debris) collect on the top flat surface of the horizontal beams, in the gap between spacer runners and Deck Plates and on the horizontal tubes of the guard rail. Debris also collect in dead corners formed between a vertical column and a stiffener bar extending at a 45 degree angle from the vertical column. The wash cycle is ineffective in removing this debris and the wash cycle itself results in a collection of water (or moisture) in these same places. The debris and water are a bacterial growth zone.

Accordingly, there exists a need for a platform that resists water and debris build-up; has increased strength; is easier, quicker and less expensive to assemble; and is HACCP and FDA compliant.

The present invention satisfies these needs, as well as others, and generally overcomes the presently known deficiencies in the art.

SUMMARY OF THE INVENTION

The present invention is directed to platform devices comprising a surface element upon which a person, equipment or both are supported.

An object of the present invention is a platform in which the build-up of debris and moisture is impeded and concomitantly enhances sanitation.

An object of the present invention is a platform system with increased structural strength and concomitantly has less structural members.

An object of the present invention is a platform system that has no screw-type fasteners and concomitantly is easy and fast to assemble.

An object of the present invention is a platform system that has no long running welds and concomitantly there is a reduction of welding time and heat deformation.

An object of the present invention is a platform system that can be shipped in sections with concomitant ease and speed of assembly.

An object of the present invention is a Hazardous Analysis of Critical Control Point compliant platform.

An object of the present invention is a Food And Drug Administration compliant platform.

One aspect of the present invention is a standard web bracket for use in a sanitary platform system for supporting a deck plate. The standard web bracket is made out of a plate having an interior area and a peripheral edge with a portion of the peripheral edge being superior and another portion of the peripheral edge being inferior. This plate has the feature of two or more tabs spaced apart along the portion of the peripheral edge being superior where the peripheral edge being superior and tabs are configured so that the tabs buttress against the deck plate. The plate has the feature of a perimeter defining an opening for receiving a main rail having a square cross-section that is run on diamond that is in the interior area.

Another aspect of the present invention is an accessory web bracket for use in a sanitary platform system for supporting a deck plate and attachment of an accessory. The accessory web bracket is made out of a plate having an interior area and peripheral edge with a portion of the peripheral edge being superior and another portion being inferior with a shape that defines a central body and two oppositely opposed arms extending away from the central body. This plate has the feature of two or more tabs spaced apart along the portion of the peripheral edge being superior where the peripheral edge being superior and tabs are configured so that the tabs buttress against the deck plate. The plate also has the feature of one or more tabs spaced apart along the portion of the peripheral edge being inferior at the central body for attachment of an accessory. There is a perimeter defining an opening for receiving a main rail on diamond that is in the interior area.

Another aspect of the present invention is a sanitary platform system with one or more deck plates above a ground surface. This system has two or more main rails having a square cross-section and length that are on diamond and are side-by-side with a space between the main rails. There are one or more standard web brackets mounted in spaced-apart relation along the length of each of the main rails. There are two or more vertical legs supporting each of the main rails above the ground surface. There are one or more deck plates welded to the tabs of the standard web brackets.

Another aspect of the present invention is a sanitary platform system as just described with one or more accessory web brackets mounted on a main rail.

The previously described versions of the present invention has many advantages which include impeding debris and moisture build-up; having enhanced structural strength and reduced number of structural members; being easy and fast to assemble; and compliant with law.

These and other features, aspects, and advantages of the present invention will become better understood with reference to the following description and appended claims.

BRIEF DESCRIPTION OF THE DRAWINGS

These and other features, aspects and advantages of the present invention will become better understood with. reference to the following description, appended claims and accompanying drawings where:

DETAILED DESCRIPTION OF THE INVENTION

Figure 1:
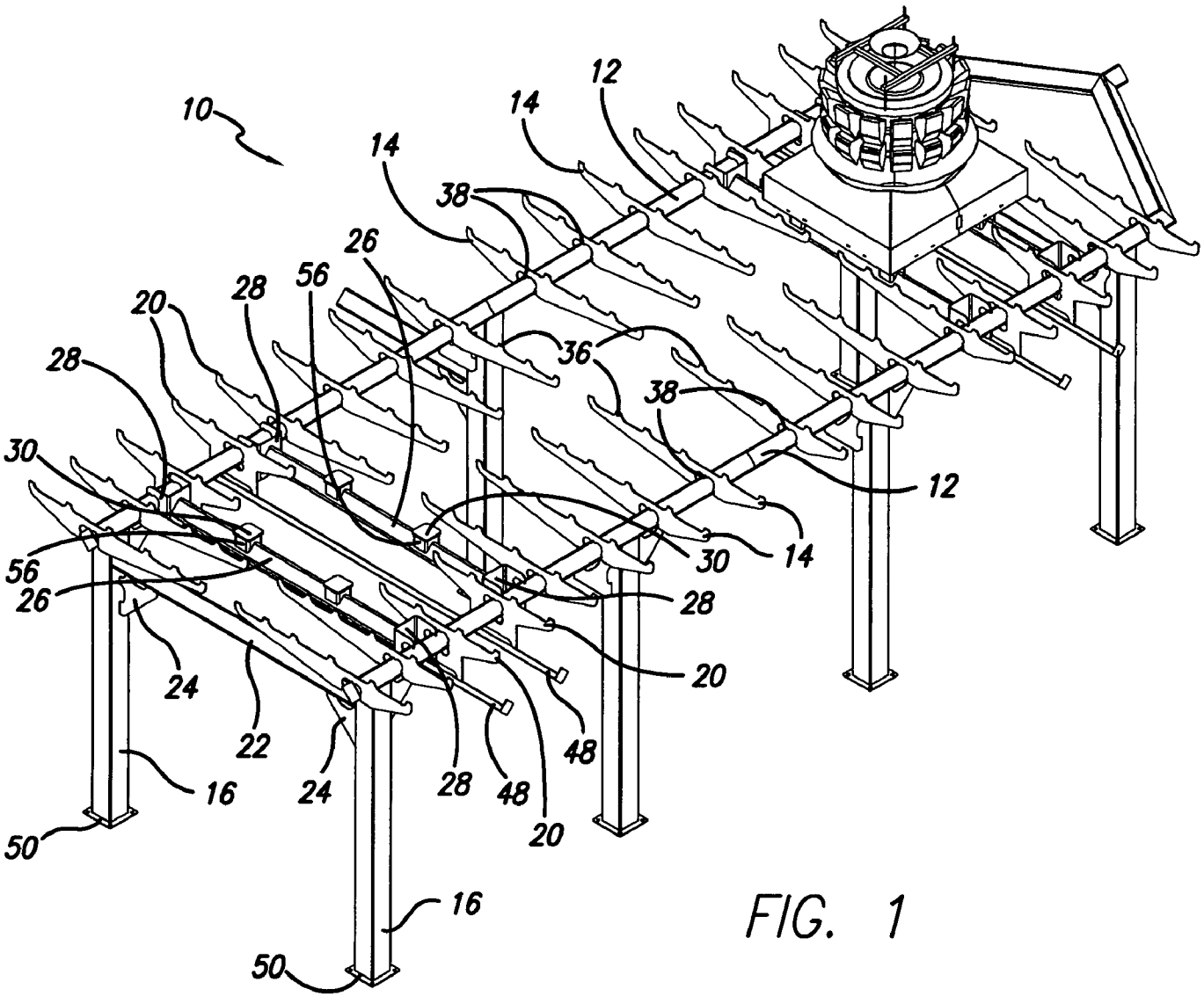
FIG. 1 is partial perspective view of a sanitary. platform system according to the present invention where deck plates are not shown.

The present invention is described more fully in the following disclosure. In this disclosure, there is a discussion of embodiments of the invention and references to the accompanying drawings in which embodiments of the invention are shown. These specific embodiments are provided so that this invention will be understood by those skilled in the art. This invention is not limited to the specific embodiments set forth herein below and in the drawings. The invention is embodied in many different forms and should be construed as such with reference to the appended claims.

Figure 8:
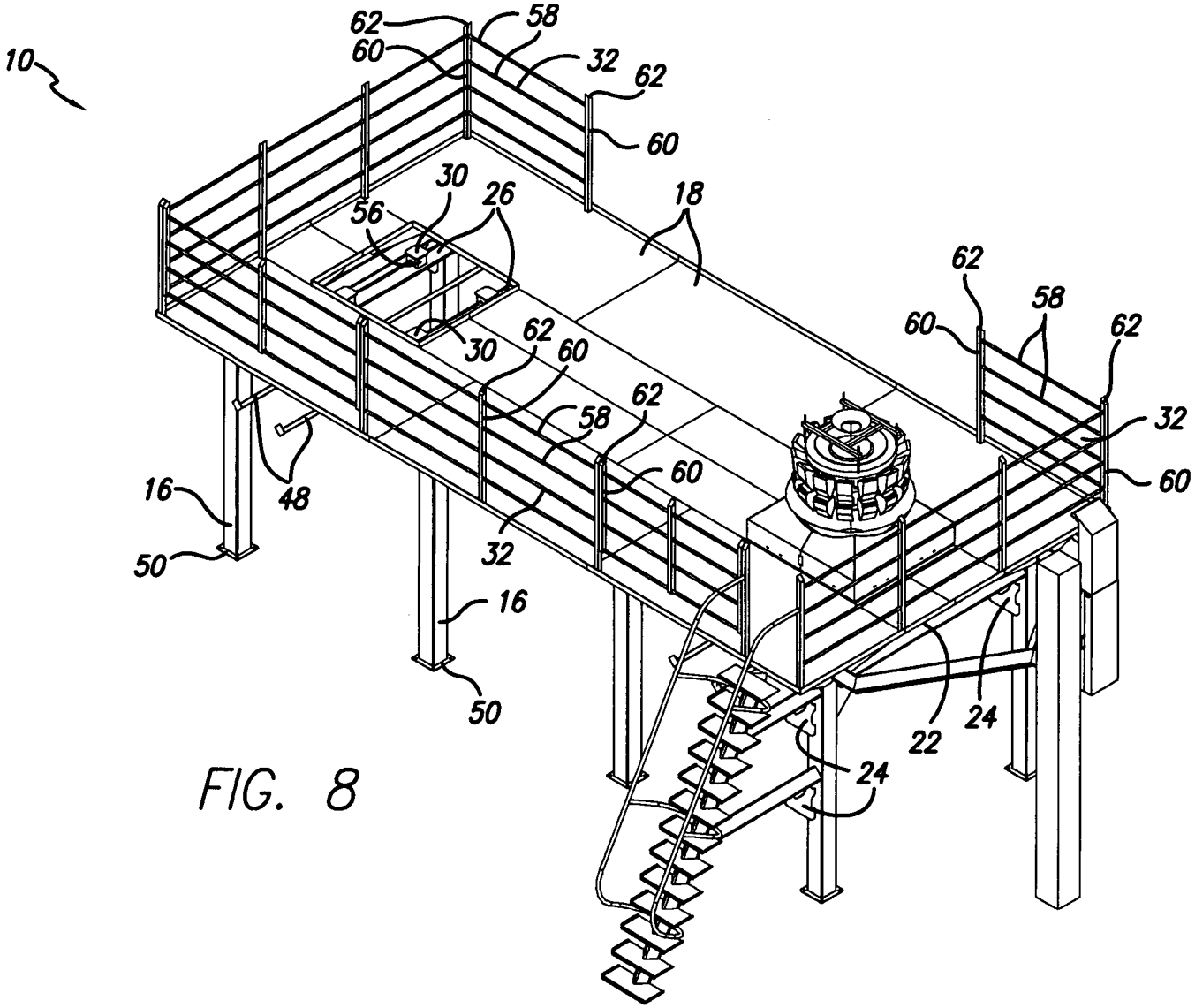
FIG. 8 is a perspective view of a sanitary platform system according to the present invention with a guard rail and stairwell.

Referring to FIG. 1 and FIG. 8, an embodiment of a Sanitary Platform System 10 is comprised of the following elements for which each element is described below: Main Rails 12; Standard Web Brackets 14; Vertical Legs 16; and Deck Plates 18. Other embodiments of a Sanitary Platform System 10 have as additional elements the following for which each element is described below: Accessory Web Brackets 20; Cross Connecting Tubes 22; Stiffener Plates 24; Accessory Cross Tubes 26; Accessory Cross Tube Mounting Brackets 28; Accessory Mounted Pads 30; and Guard Rail System 32.

Referring to FIG. 1, a Main Rail 12 is an elongated structural member which has length. Preferably, the Main Rail 12 has a square cross-section. The Main Rail 12 is made of metal. A preferred material is galvanized Stainless Steel (SS) and a most preferred material is 11-gauge galvanized SS304 or galvanized SS316. Carbon steal and aluminum should be avoided because of a lack of cleanliness, reactivity to caustic cleaning foams and legal prohibitions. The Main Rail 12 can be either solid or hollow with hollow being preferred because of material and weight savings. A preferred dimension for the Main Rail 12 is a two-inch square.

The Main Rail 12 runs horizontally and is supported above a ground surface by two or more Vertical Legs 16. A main rail having a square cross-section can be oriented on the Vertical Legs 16 such that a top side (and axiomatically, also a bottom side) of the square tube is essentially parallel to the ground surface and such an orientation is called "lying on flat." Viewing the end of a main rail lying on flat, one sees a square.

A Main Rail 12 having a square cross-section can be oriented on the Vertical Legs 16 such that two diagonal vertices of the square cross-section are stacked vertically over each other and this orientation is called "on diamond." Viewing the end of a Main Rail 12 on diamond, one sees a diamond. A Main Rail 12 on diamond can be conceptualized as a main rail lying on flat that is rotated about forty-five degrees relative to lying on flat.

A Main Rail 12 on diamond is stronger than a main rail lying on flat. This in turns results in greater spacing between Main Rails 12 on diamond in a platform system compared to the spacing between main rails lying on flat in a Sanitary Platform System 10. In wider Sanitary Platform Systems 10, fewer rows of Main Rails 12 on diamond are needed compared to the needed number of rows of main rails lying on flat.

Referring to FIG. 1, mounted onto the Main Rail 12 there are Standard Web Brackets 14 and, optionally, Accessory Web Brackets 20.

Figure 3:
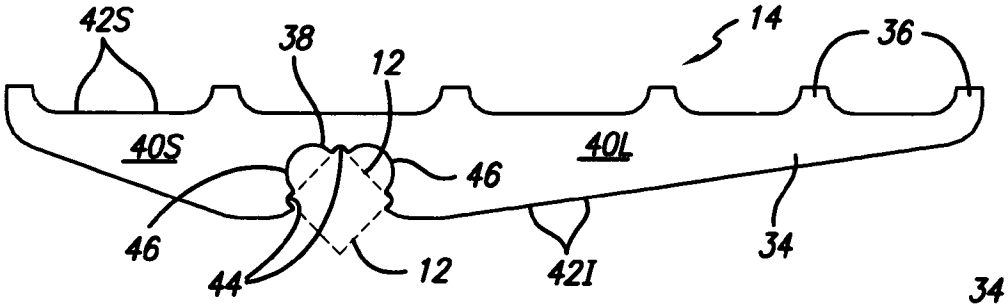
FIG. 3 is a side elevation view of a standard web bracket according to the present invention.

Referring to FIG. 3, an embodiment of a Standard Web Bracket 14 is comprised of a Plate 34, Tabs 36 and a Perimeter Defining an Opening for Receiving a Main Rail on Diamond 38.

Continuing to refer to FIG. 3, the Plate 34 is planar, has thickness and is of sufficient strength to support a load on a Deck Plate 34. A preferred shape is an irregular trapezoid or triangle defining a long and short arm 40S, 40L relative to the Perimeter Defining an Opening for Receiving a Main Rail on Diamond 38. The Plate 34 is made out of metal. Preferred metals are 7-gauge galvanized SS304 and 7-gauge galvanized SS 306. The overall shape of the Plate 34 and features that are added thereto can be formed by molding, stamping, machining or laser cutting. Laser cutting is a preferred method with all features being formed at the same time so as to reduce manufacturing costs.

The Plate 34 has an Interior Area 40 and a Peripheral Edge 42. When the Standard Web Bracket 14 is mounted on a Main Rail 12 in a Sanitary Platform System 10, a portion of this Peripheral Edge 42 of the Plate 34 is superior and another portion is inferior and these portions are respectively referred to as the Portion of the Peripheral Edge Being Superior 42S and the Portion of the Peripheral Edge Being Inferior 42I. In a preferred embodiment, the Portion of the Peripheral Edge Being Superior 42S is linear so as to facilitate Tabs 36 buttressing against a. Deck Plate 34.

As mentioned, in a preferred embodiment of the Standard Web Bracket 14, the Plate 34 approximates an irregular trapezoid or triangle with one angle side longer than the other side. Accordingly, there is defined a short and long arm 40S, 40L relative to the Perimeter Defining an Opening for Receiving a Main Rail on Diamond 38. This irregular trapezoidal or triangular shape minimizes material, preserves structural strength, cooperates with positioning for the Main Rails 12 and Vertical Legs 16 of a Sanitary Platform System 10 and is easy to fabricate. The approximate irregular trapezoid or triangle is oriented such that a long linear side is the Portion of the Peripheral Edge Being Superior 42S and two short angle sides are part of the Portion of the Peripheral Edge Being Inferior 42I.

In a most preferred embodiment, the length of the Plate 34 approaches the width of a Deck Plate 34 so as to facilitate distribution of a load on the Deck Plate 34 without there being a cantilever force on the Deck Plate 34. For example, with an 83-inch-wide Deck Plate 34, the Standard Web Bracket 14 is comprised of a Plate 34 80 inches in length (The Plate 34 is 10 inches in width at the widest point).

Continuing to refer to FIG. 3, Tabs 36 are stubs emanating from the Peripheral Edge Being Superior 42S. The Tabs 36 are a support and a weld mount for a Deck Plate 34. The Tabs 36 and the Portion of the Peripheral Edge Being Superior 42S of the Plate 34 are configured so that the Tabs 36 buttress against a Deck Plate 34. The length of a Tab 36 is sufficiently long so that a secure weld can be made between the Tab 36 and a Deck Plate 34. The length of the Tab 36 is not so long that running a weld the length of the Tab 36 results in thermal distortion of the Deck Plate 34. A preferred shape for Tabs 36 is a rectangle and preferred dimensions are 2 inches in length and 0.75 inch in height.

Preferably, there are two or more Tabs 36 with two Tabs 36 positioned at the ends of the Portion of the Peripheral Edge Being Superior 42S of the Plate 34 with additional Tabs 36 spaced apart between the ends, the Tabs 36 positioned along the Portion of the Peripheral Edge Being Superior 42S of the Plate 34 so as to distribute the weight of a load on the deck plate. In a most preferred embodiment, there are a sufficient number of Tabs 36 spaced apart along the Portion of the Peripheral Edge Being Superior 42S so as to distribute a load on a Deck Plate 34 without there being a cantilever force on the Deck Plate 34.

Continuing to refer to FIG. 3, a Perimeter Defining an Opening for Receiving a Main Rail on Diamond 38 in the Interior Area 40 of the Plate 34 is an aperture configured to receive in supporting relation a Main Rail 12 oriented on diamond. A preferred embodiment of the Perimeter Defining an Opening for Receiving a Main Rail on Diamond 38 is shaped to have first, second and third Relief Welds 44 (described below) that are orthogonal, a first Wash Out Gap 46 (described below) between the first and second Relief Welds 44 and a second Wash Out Gap 46 between the second and third Relief Welds 44, and a perimeter extending from the Portion of the Peripheral Edge Being Inferior into the Interior Area.

A Relief Weld 44 is an arch in a perimeter that conformingly receives vertices of the cross-section of the Main Rail 12. In the aforementioned preferred embodiment of the Perimeter Defining an Opening for Receiving a Main Rail on Diamond 38, the three orthogonal Relief Welds 44 form a positioning jig for the Main Rail 12. This adds to the ease of assembly of a Sanitary Platform System 10 according to the present invention. When a Sanitary Platform System 10 is welded together, the Relief Welds 44 minimize heat distortion (thermal expansion) of the Main Rail 12 and Standard Web Bracket 14 and thereby enhance mechanical strength.

A Wash Out Gap 46 is an arch in the Perimeter Defining an Opening for Receiving a Main Rail on Diamond 38 such that when the Standard Web Bracket 14 is mounted on the Main Rail 12 there is gap between surface of the Main Rail 12 and the Plate 34. As the name implies, a Wash Out Gap 46 improves washability.

Figure 4:
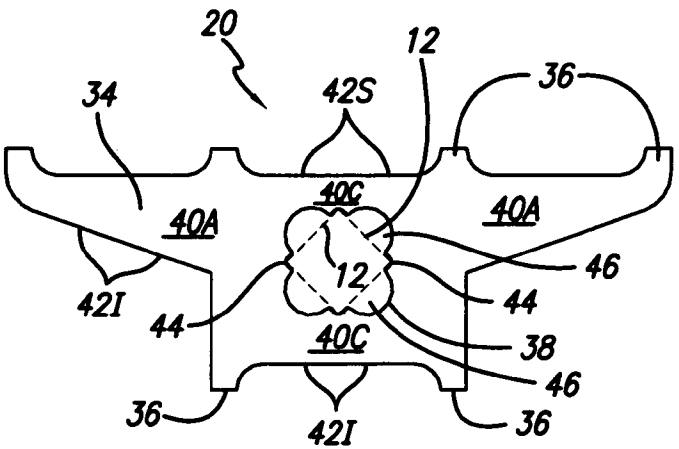
FIG. 4 is a side elevation view of an accessory web bracket according to the present invention.

Referring to FIG. 4, an embodiment of an Accessory Web Bracket 20 is comprised of a Plate 34, Tabs 36 and a Perimeter Defining an Opening for Receiving a Main Rail on Diamond 38.

The Plate 34 is substantially the same as that in a Standard Web Bracket 14. The Plate 34 has an Interior Area 40 and peripheral edge with a Portion of the Peripheral Edge Being Superior 42S and another Portion of the Peripheral Edge Being Inferior 42I. The Plate 34 is shaped to have a central section referred to as the Central Body 40C and two Oppositely Opposed Arms 40A extending away from the Central Body 40C. A preferred embodiment for the Plate 34 is a rectangularly shaped Central Body 40C with the long length of the rectangle being vertical and right triangularly shaped Oppositely Opposed Arms 40A in a "T" formation. This shape minimizes materials, provides structural strength and minimizes interference with other structural members in the Sanitary Platform System 10.

Tabs 36 along the Portion of the Peripheral Edge Being Superior 42S are substantially the same as that in a Standard Web Bracket 14. The Portion of the Peripheral Edge Being Superior 42S and Tabs 36 are configured so that the Tabs 36 buttress against the Deck Plate 34. Preferably, the Accessory Web Bracket 20 has two or more Tabs 36 with Tabs 36 at the ends of the of the Portion of the Peripheral Edge Being Superior 42S and additional Tabs 36 in between.

Figure 6:
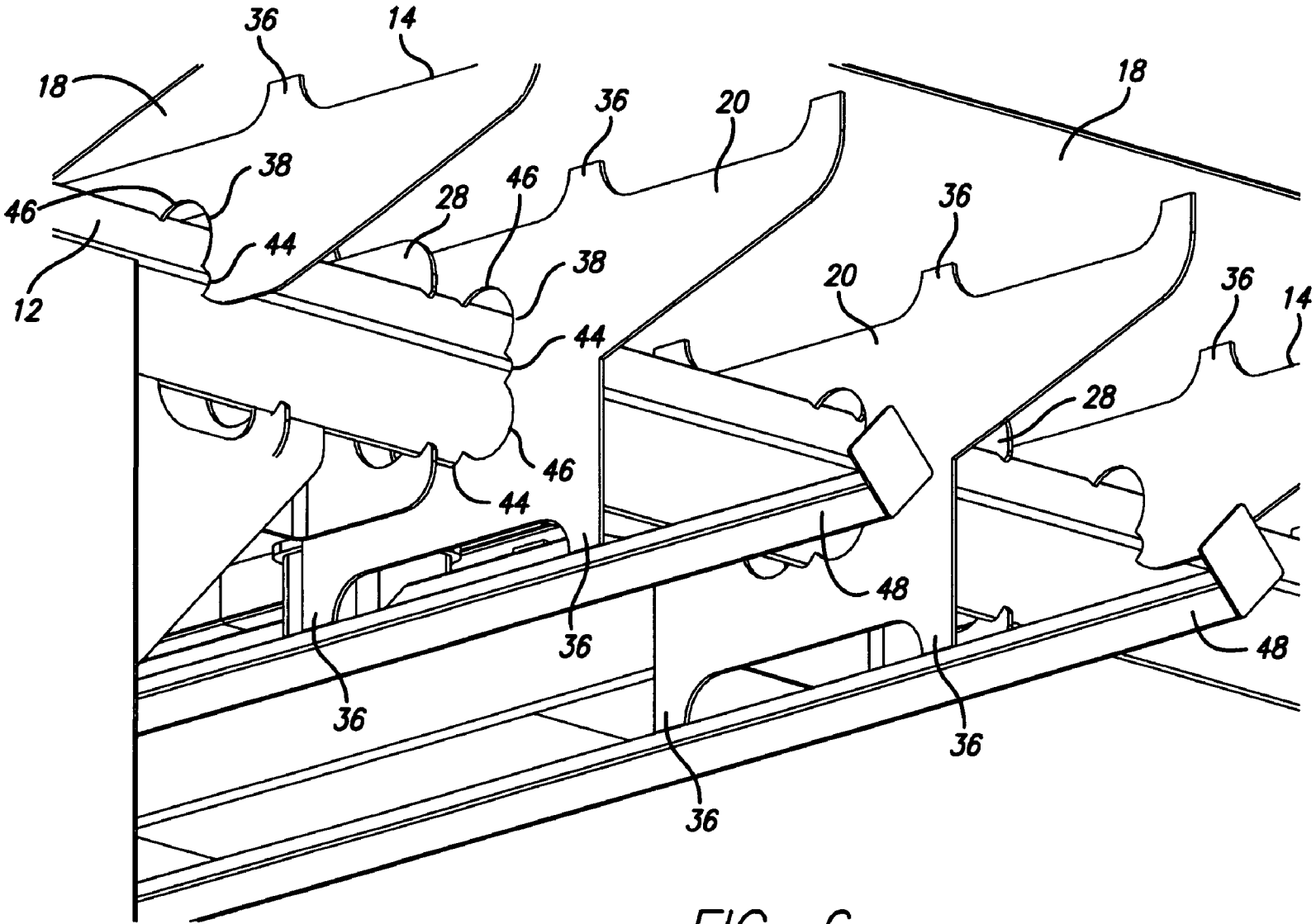
FIG. 6 is a partial perspective view of a sanitary platform system according to the present invention having accessory web brackets which support a frame for a conveyor and stiffener plate.

Referring to FIG. 4 and FIG. 6, the Accessory Web Bracket has one or more Tabs 36 spaced apart along the Portion of the Peripheral Edge Being Inferior 42I for attachment of an accessory/accessory mounting bracket 48. An accessory is piece of equipment that is used in connection with a Sanitary Platform System 10 that is not readily moved from one location to another or is wanted to be stationary, such as a conveyor system, scale and bagger. These Tabs 36 are substantially the same as those previously described. The accessory is either attached directly or via frame or brackets to the Tabs 36. The Tabs 36 are typically positioned along the Portion of the Peripheral Edge Being Inferior 42I that runs along the Central Body 40C. The size and number of Tabs 36 conforms to the structural needs to support the accessory.

Referring to FIG. 4, the Perimeter Defining an Opening for Receiving a Main Rail on Diamond 38 is similar to that in a Standard Web Bracket 14. It is located in the Interior Area 40C of the Plate 34 and is an aperture that is configured to receive in supporting relation a Main Rail 12 oriented on diamond. A preferred embodiment of the Perimeter Defining an Opening for Receiving a Main Rail on Diamond 38 is shaped to have first, second, third and fourth Relief Welds 44 that are orthogonal, a first Wash Out Gap 46 between the first and second Relief Welds 44, a second Wash Out Gap 46 between the second and third Relief Welds 44, a third Wash Out Gap 46 between the third and fourth Relief Welds 44, and a fourth Wash Out Gap 46 between the fourth and first Relief Welds 44.

Referring to FIG. 1, the Vertical Leg 16 is an elongated structural member which supports a Main Rail 12 above a ground surface (e.g., the floor of a building). The Vertical Leg 16 has two ends of which one end is a bottom and the other end is a top. The bottom end rests on the ground surface. The top end receives a Main Rail 12. The Vertical Leg 16 is made out of metal. A preferred metal is 11-gauge galvanized SS304 and 11-gauge galvanized SS306. A preferred cross-sectional shape for the Vertical Leg is a square and preferred dimension is an 8-inch square.

In a preferred embodiment of the Vertical Leg 16, there is an end cap plate 50 at the bottom of the Vertical Leg 16 which is a planar footing interface between the Vertical Leg 16 and ground surface. In connection with a Vertical Leg 16 having an 8-inch square cross-section, a 9-inch square end cap Plate 34 is used.

In a most preferred embodiment of the Vertical Leg 16, the top has a V-Shaped Saddle (not illustrated) for receiving a Main Rail 12 on diamond in supporting relation. The sides of the V-Shaped Saddle are cut at 45-degree angles to conform to the square cross-section of the Main Rail 12. The V-Shaped Saddle facilitates fast installation of the Sanitary Platform System 10

By virtue of the Vertical Legs 16 supporting Main Rails 12 above p ground surface, the Deck Plates 18 of the platform system are raised above the ground surface with open space underneath the Deck Plates 18. The open space can be utilized for accessories such as a conveyor system, bagger and weigh scale.

Figure 5:
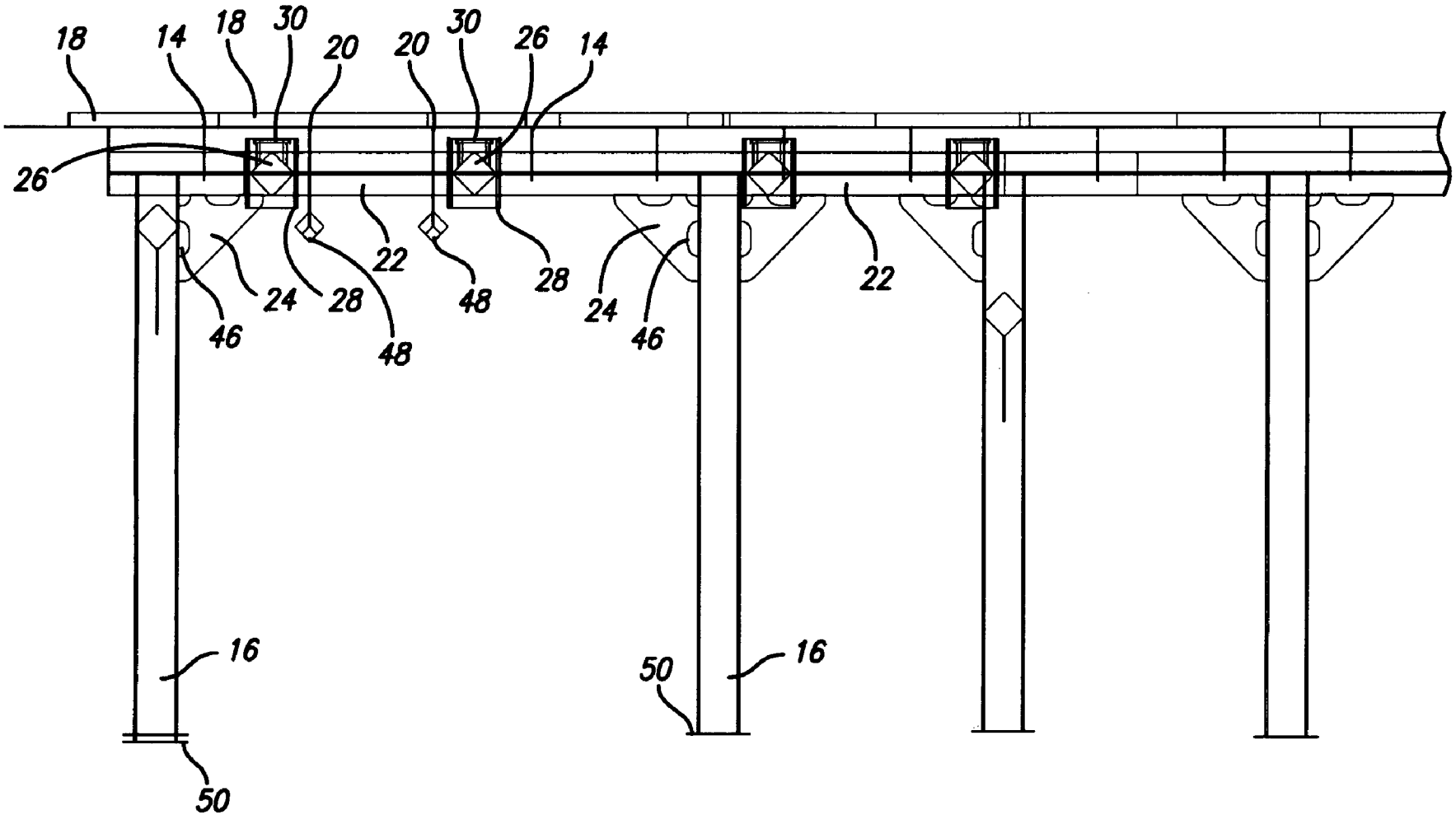
FIG. 5 is a partial side plan view of a sanitary platform system according to the present invention where the entire length of the system is not shown.

Referring to FIG. 1 and FIG. 5, a Cross Connecting Tube 22 is an elongated structural member that connects two Vertical Legs 16. A Cross Connecting Tube 22 facilitates easier and faster installation of the Sanitary Platform System 10 and stabilizes and strengthens the Sanitary Platform System 10. The Cross Connecting Tube 22 preferably has a square cross-sectional shape and runs on diamond in a horizontal fashion to connect Vertical Legs 16 at or near their top. The Cross Connecting Tube 22 is made out of metal. A preferred metal is 11-gauge galvanized SS304 and 11-gauge galvanized SS306. A preferred dimension for a Cross Connecting Tube 22 having a square cross-section is a 6 inch square. By running on diamond, water drips and slides off the surfaces of the Cross Connecting Tube 22 so as to resist the formation of a bacterial growth zone.

Referring to FIG. 5 and FIG. 6, a Stiffener Plate 24 is a knee between a Vertical Leg 16 and a Cross Connecting Tube 22 adjoining that Vertical Leg 16. The Stiffener Plate 24 buttresses in close relationship against the Vertical Leg 16 and Cross Connecting Tube 22 so that there is no dead corner. A dead corner is a junction between two structural members which results in a pocket, nook, cranny or region in which debris and water can collect. The Stiffener Plate 24 stabilizes and strengthens the sanitary platform by taking out wobble at the connection between a Vertical Leg 16 and a Cross Connecting Tube 22. Preferably, the Stiffener Plate 24 is triangular in shape. The Stiffener Plate 24 is made out of metal. A preferred metal is 7-gauge galvanized SS304 and 7-gauge galvanized SS306. Optionally, the Stiffener Plate 24 can have one or more Wash Out Gaps 46 at the mating surface with a Vertical Leg 16 and/or Cross Connecting Tube 22.

Referring to FIG. 1, an Accessory Cross Tube 26 is an elongated structural member that attaches between two side-by-side Main Rails 12 in a Sanitary Platform System 10 that functions to support an accessory. Preferably, the Accessory Cross Tube 26 has a square cross-sectional shape and runs on diamond between the side-by-side Main Rails 12 to which it is attached. The Accessory Cross Tube 26 is made out of metal. A preferred metal is 11-gauge galvanized SS304 and 11-gauge galvanized SS306. A preferred dimension for the Accessory Cross Tube 26 having a square cross-section is a 6-inch square. By running on diamond, water drips and slides off the surfaces of the Cross Connecting Tube 22 so as to resist the formation of a bacterial growth zone.

Figure 7:
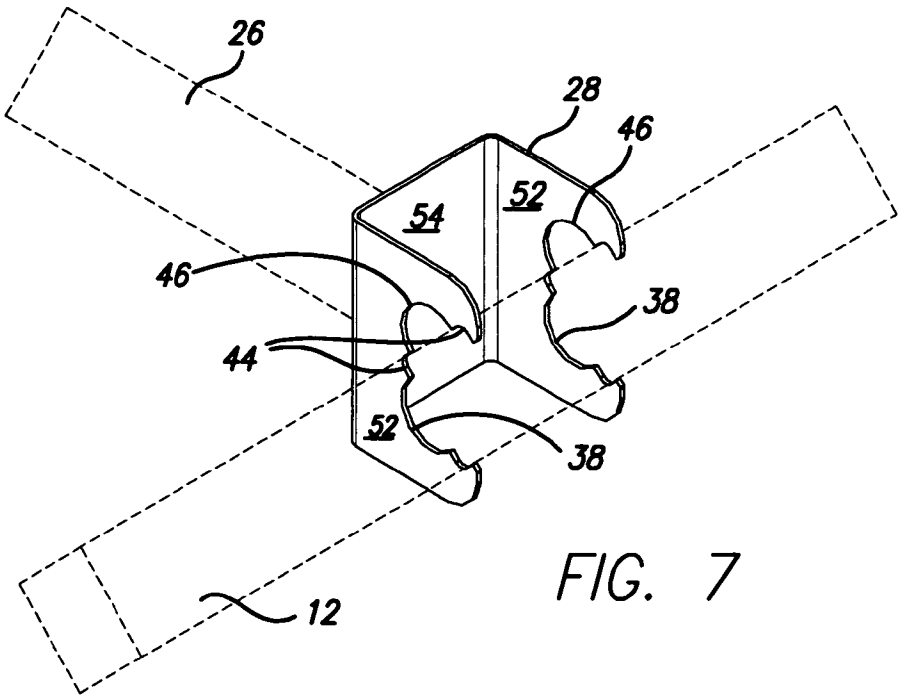
FIG. 7 is a perspective view of an accessory cross tube mounting bracket according to the present invention.

Referring to FIG. 1 and FIG. 7, an Accessory Cross Tube Mounting Bracket 28 is a joint member for attaching an Accessory Cross Tube 26 to a Main Rail 12. A preferred Accessory Cross Tube Mounting Bracket 28 is a "U"-bent plate having two oppositely opposed side walls 52 and center face wall 54. Each of the side walls 52 of the Accessory Cross Tube Mounting Bracket 28 has a Perimeter Defining an Opening For Receiving a Main Rail on Diamond 38. This facilitates the Accessory Cross Tube Mounting Bracket 28 being slid onto a Main Rail 12 for easier and faster assembly of a sanitary platform. In a preferred embodiment of the Accessory Cross Tube Mounting Bracket 28, this Perimeter Defining an Opening for Receiving a Main Rail on Diamond 38 in the side wall 52 is shaped to have first, second and third Relief Welds 44 that are orthogonal, a first Wash Out Gap 46 between the first and second Relief Welds 44, and a second Wash Out Gap 46 between the second and third Relief Welds 44, with the perimeter extending from the end of the side wall into the interior of the sidewall.

An Accessory Cross Tube 26 is secured to the center face wall 54 of the Accessory Cross Tube Mounting Bracket 28 by welding. Optionally, the center face wall 54 of the Accessory Cross Tube Mounting Bracket 28 has a perimeter defining an opening for receiving an Accessory Cross Tube 26 on diamond (not illustrated). This facilitates the Accessory Cross Tube 26 being slid into the Accessory Tube Mounting Bracket 28 for easier and faster assembly of a sanitary platform. In a preferred embodiment of the Accessory Cross Tube Mounting Bracket 28, this perimeter defining an opening for receiving an Accessory Cross Tube 26 is shaped to have first, second, third and fourth relief welds that are orthogonal, a first wash out gap between the first and second relief welds, a second wash out gap between the second and third relief welds, a third wash out gap between the third and fourth relief welds, and a fourth wash out gap between the fourth and first relief welds.

An Accessory Mounting Pad 30 is a structural interface between an Accessory Cross Tube 26 and an accessory, onto which to seat an accessory. The Accessory Mounting Pad 30 has a top portion onto which to seat an accessory and a bottom portion that receives an Accessory Cross Tube 26. Preferably, the bottom portion of the Accessory Mounting Pad 30 is an inverted "V"-shaped saddle 56 that is adopted to be received in close relation on to the Accessory Cross Tube 26 on diamond.

Referring to FIG. 7, optionally, there is a Guard Rail System 32. Preferably, the horizontal tubes 58 of the Guard Rail System 32 have a square cross-section and run on diamond. By running on diamond, water drips and slides off the surfaces of the horizontal tube 58 so as to resist the formation of a bacterial growth zone. In the present invention, the vertical posts 60 Guard Rail System 32 terminate in a solid surface on an angle 62. A preferred angle is about 30 degrees. By being solid and angled, water drips and slides off the surface so as to resist the formation of a bacterial growth zone.

Figure 2:
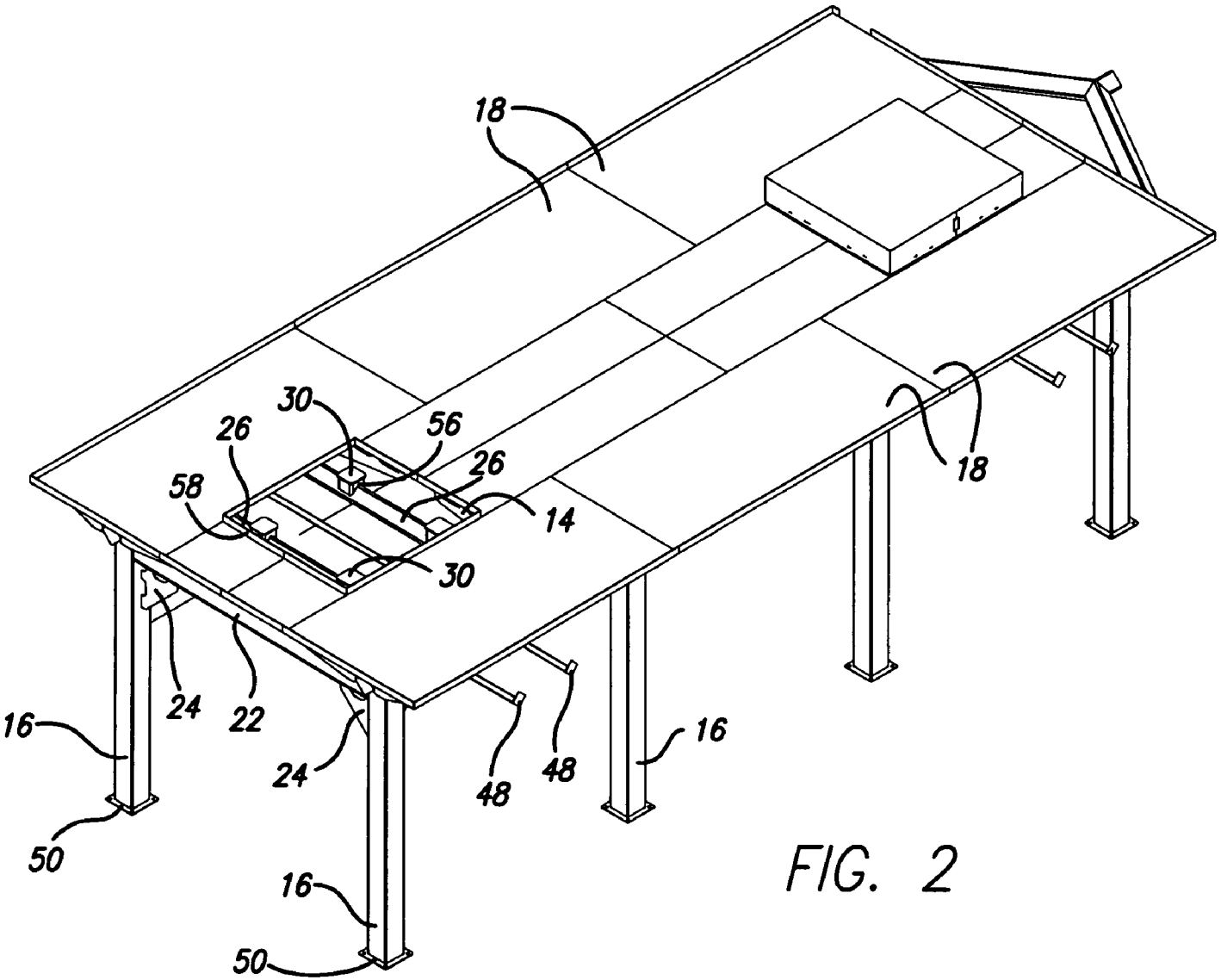
FIG. 2 is a partial perspective view of the sanitary platform system according to the present invention with deck plates.

Referring to FIG. 2 and FIG. 7, Deck Plates 18 are mounted onto the Tabs 36 on the Portion of the Peripheral Edge Being Superior 42S of Standard Web Brackets 14 and Accessory Web Brackets 20 so as to form a platform. There are three types of Deck Plates 18; namely, solid tread plates, fiberglass grid and stainless steel grid. A solid tread plate has criss-crossed ridges for friction. Preferably, the Deck Plates 18 are mounted by welding. As mandated by OSHA regulations, there is a raised edging or lip along the edge of a Deck Plate 34 that makes up the exterior of the platform system.

The Sanitary Platforms System 10 is made and used as follows. Referring to FIG. 1, two or more Main Rails 12 are selected. The wider the platform the greater the number of Main Rails 12. These Main Rails 12 are approximately parallel and aligned in a side-by-side configuration with space between the Main Rails 12 commensurate with the length of the Standard Web Brackets 14 which will be mounted onto the Main Rails. Preferably, the Main Rails 12 are spaced a distance apart such that there is a small gap or distance between the ends of oppositely opposed Standard Web Brackets 14 on each of the side-by-side Main Rails 12.

Referring to FIG. 1 and FIG. 6, Standard Web Brackets 14, Accessory Web Brackets 20 and Accessory Cross Tube Mounting Brackets 28 are slid onto the Main Rails 12 in the positional order that they are desired in the Sanitary Platform System 10. The longer the Main Rails 12 and, hence, the longer the platform, the greater the number of Standard Web Brackets 14. Where the Standard Web Brackets 14 have a long arm 40L and short arm 40S, the Standard Web Brackets 14 are mounted on adjacent side-by-side Main Rails 12 so that long arms face each other. The number and position of Accessory Web Brackets 20, if any, and the number of Accessory Cross Tube Mounting Brackets 28 is determined by the desired accessories to be used with the Sanitary Platform System 10. Welding is used to secure the Standard Web Brackets 14, Accessory Web Brackets 20 and Accessory Cross Tube Mounting Brackets 28 to the Main Rails 12.

Referring to FIG. 1 and FIG. 5, Cross Connecting Tubes 22, Accessory Cross Tubes 26 and Accessory Cross Tube Mounting Pads 30 are selected. In a preferred embodiment there are Cross Connecting Tubes 22 connecting the ends of side-by-side Main Rails 12 with additional Cross Connecting Tubes 22 connecting adjacent Vertical Legs 16. The Accessory Cross Tubes 26 are selected in accordance with the Accessory Cross Tube Mounting Brackets 28 that were slid on the Main Rails 12 based on the desired accessories. Accessory Mounting Pads 30 are placed on the Accessory Cross Tubes 26 at desired positions for accessories. Welding is used to secure components.

Continuing to refer to FIG. 1 and FIG. 5, each of the Main Rails 12 is supported by at least two Vertical Legs 16 which are preferably positioned at the ends of the Main Rail 12 with additional Vertical Legs 16 there between. The longer the Main Rail 12, the greater the number of Vertical Legs 16 which are used to support it. Preferably, welding is used to secure the Main Rails 12 to the Vertical Legs 16. In a preferred embodiment, the Main Rails 12 are seated in a V Saddle (not illustrated) at the top of the Vertical Leg 16. In a most preferred embodiment, there are Stiffener Plates 24 at the junctions between Vertical Legs 16 and Main Rails 12. The Stiffener Plate 24 is welded to and along the lower vertices of the Main Rail 12 on diamond and the Vertical Leg 16.

Referring to FIG. 2, FIG. 5 and FIG. 8, one or more Deck Plates 18 are welded to the Standard Web Bracket 14 and Accessory Web bracket 20 at the Tabs 36 so as to form a platform. Referring to FIG. 8, an optional Guard Rail System 32 can be welded to the platform at about the perimeter of the platform.

A Sanitary Platform System 10 according to the present invention can be shipped in sections with concomitant ease and speed of assembly.

The Sanitary Platform System 10 is used to provide surface above a ground surface to be utilized as a work area and/or to support machinery with an open space underneath to be potentially utilized by machinery. In being so utilized, there is a load or weight force on the Deck Plates 18 from the weight of human beings and equipment which is supported by the Sanitary Platform System 10.

The previously described versions of the present invention have many advantages. One advantage is all of the horizontal members are on diamond. As such, there is increased structural strength. Further, water runs off the angle surfaces such that water does not collect to form a bacterial growth zone.

Another advantage is the ease of assembly. The Standard Web Brackets 14, Accessory Web Brackets 20 and Accessory Cross Tube Mounting Brackets 28 slide into place on Main Rails 12. The Vertical Legs 16 and Accessory Mounting Brackets have "V"-shaped saddles to drop onto or into Main Rails 12. The Sanitary Platform System 10 can be assembled by welding together all of the components without any nuts, bolts or other fasteners.

EXAMPLES

The following examples further describe and demonstrate embodiments within the scope of the present invention. The examples are given solely for the purpose of illustration and are not to be construed as limitations or restrictions of the present invention, as persons skilled in the art will quickly realize many variations thereof are possible that are all within the spirit and scope of the invention.

Example 1

This example is a component description for a sanitary platform system according to the present invention and depicted in the drawings. The example includes horizontal tubing on diamond for securing the platform to a wall, a staircase, a guardrail system and accessory web bracket and other framing for bagger, scale and conveyor accessories.

| Description | Quantity | Unit |
|---|---|---|
| Tube, square welded number 304 stainless steel 180-grit 1-inch by 11-gauge | 251.42 | feet |
| Plate, end cap 2-inch by 2-13/16, 45-degree 2 tube | 20 | each |
| Handrail, stair, mezzanine | 1 | each |
| Handrail, stair, mezzanine | 1 | each |
| Support, railing mezzanine steps | 4 | each |

-continued

| Description | Quantity | Unit |
|---|---|---|
| Step, top, mezzanine | 1 | each |
| Step, middle, mezzanine | 12 | each |
| Plate, support, ultra clean leg mount | 4 | each |
| Plate, end cap | 8 | each |
| Plate, end cap | 4 | each |
| Plate, end cap, 2-inch by 2-inch square tube (10 galvanized) | 12 | each |
| Plate, end cap, 4-inch by 4-inch by 11 galvanized with ⅛-inch exhaust | 1 | each |
| Plate, end cap, 4-inch by 4-inch by 11 galvanized | 7 | each |
| Weldment, deck plate, mezzanine | 2 | each |
| Weldment, deck plate, mezzanine | 2 | each |
| Plate, deck, mezzanine | 4 | each |
| Plate, deck, mezzanine | 2 | each |
| Plate, deck, mezzanine | 2 | each |
| Plate, base, vertical tube | 6 | each |
| Bracket, support, tube gusset | 15 | each |
| Bracket, support, tube | 8 | each |
| Bracket, support, tube | 24 | each |
| Bracket, support, tube | 8 | each |
| Tube, square welded number 304 stainless steel 180-grit 2-inch by 11-gauge | 156.68 | feet |
| Tube, square welded number 304 stainless steel 180-grit 6-inch by 7-gauge | 149.99 | feet |
| Tube, square welded number 304 stainless steel mill finish 8-inch by 11-gauge | 60.94 | feet |

Example 2

This example is a cut sheet for a sanitary platform system according to the present invention of Example 1 and depicted in the drawings. The example includes horizontal tubing on diamond for securing the platform to a wall, a stair case, a guard rail system and accessory web bracket and other framing for bagger, scale and conveyor accessories.

| Quantity | Material Size | Length | Bottom Cut Angle | Top Cut Angle |
|---|---|---|---|---|
| 1 | 8-inch square by 11-gauge galvanized Stainless Steel Tube | 104-7/16 inches | 90 degrees straight | 45 degrees V slants |
| 1 | 8-inch square by 11-gauge galvanized Stainless Steel Tube | 103-5/8 inches | 90 degrees straight | 45 degrees V slants |
| 1 | 8-inch square by 11-gauge galvanized Stainless Steel Tube | 103-13/16 inches | 90 degrees straight | 45 degrees V slants |
| 1 | 8-inch square by 11-gauge galvanized Stainless Steel Tube | 104-1/2 inches | 90 degrees straight | 45 degrees V slants |
| 1 | 8-inch square by 11-gauge galvanized Stainless Steel Tube | 104-13/16 inches | 90 degrees straight | 45 degrees V slants |
| 1 | 8-inch square by 11-gauge galvanized Stainless Steel Tube | 104-3/16 inches | 90 degrees straight | 45 degrees V slants |
| 1 | 8-inch square by 11-gauge galvanized Stainless Steel Tube | 105-7/8 inches | 90 degrees straight | 45 degrees V slants |
| 4 | 6-inch square by 11-gauge galvanized Stainless Steel Tube | 170 inches | 90 degrees straight | 90 degrees straight |
| 1 | 6-inch square by 11-gauge galvanized Stainless Steel Tube | 14-11/16 inches | 90 degrees straight | 28.5 degrees/ slant |
| 1 | 6-inch square by 11-gauge galvanized Stainless Steel Tube | 11-5/8 inches | 90 degrees straight | 30.0 degrees \ slant |

-continued

| Quantity | Material Size | Length | Bottom Cut Angle | Top Cut Angle |
|---|---|---|---|---|
| 1 | 6-inch square by 11-gauge galvanized Stainless Steel Tube | 11-9/16 inches | | |
| 2 | 6-inch square by 11-gauge galvanized Stainless Steel Tube | 104-1/2 inches | 90 degrees straight | 90 degrees straight |
| 4 | 6-inch square by 11-gauge galvanized Stainless Steel Tube | 96-1/2 inches | 90 degrees straight | 90 degrees straight |
| 1 | 6-inch square by 11-gauge galvanized Stainless Steel Tube | 56-7/8 inches | 90 degrees straight | 90 degrees straight |
| 4 | 2-inch square by 11-gauge galvanized Stainless Steel Tube | 151-3/8 inches | 90 degrees straight | 90 degrees straight |
| 8 | 6-inch square by 11-gauge galvanized Stainless Steel Tube | 4-5/8 inches | 90 degrees straight | 45 degrees V slants |
| 1 | 6-inch square by 11-gauge galvanized Stainless Steel Tube | 64-11/16 inches | 28.5 degrees\ slant | 30.0 degrees/ slant |
| 1 | 6-inch square by 11-gauge galvanized Stainless Steel Tube | 76-9/16 inches | 30.0 degrees\ slant | 31.5 degrees/ slant |
| 1 | 6-inch square by 11-gauge galvanized Stainless Steel Tube | 130-5/8 | 30 degrees/ slant | 30.0 degrees/ slant |
| 14 | 2-inch square by 11-gauge galvanized Stainless Steel Tube | 54 inches | 90 degrees straight | 45.0 degrees/ slant |
| 6 | 2-inch square by 11-gauge galvanized Stainless Steel Tube | 42-11/16 inches | 90 degrees straight | 45.0 degrees/ slant |
| 4 | 2-inch square by 11-gauge galvanized Stainless Steel Tube | 50-3/4 inches | 20 degrees/ slant | 20.0 degrees/ slant |
| 4 | 2-inch square by 11-gauge galvanized Stainless Steel Tube | 14-7/8 inches | 90 degrees straight | 20.0 degrees/ slant |
| 1 | 6-inch square by 11-gauge galvanized Stainless Steel Tube | 66-1/2 inches | 90 degrees straight | |
| 1 | 6-inch square by 11-gauge galvanized Stainless Steel Tube | 43-15/16 inches | 90 degrees straight | |
| 8 | 1-inch square by 11-gauge galvanized Stainless Steel Tube | 36-5/16 inches | 90 degrees straight | 90 degrees straight |
| 8 | 1-inch square by 11-gauge galvanized Stainless Steel Tube | 51-7/16 inches | 90 degrees straight | 90 degrees straight |
| 8 | 1-inch square by 11-gauge galvanized Stainless Steel Tube | 62-11/16 inches | 90 degrees straight | 90 degrees straight |
| 8 | 1-inch square by 11-gauge galvanized Stainless Steel Tube | 65-5/8 inches | 90 degrees straight | 90 degrees straight |
| 24 | 1-inch square by 11-gauge galvanized Stainless Steel Tube | 53-11/16 inches | 90 degrees straight | 90 degrees straight |

Example 3

This example presents the order and spacing of Standard Web Bracket and Accessory Web Bracket along a Main Rail in a sanitary platform system according to the present invention of Examples 1 and 2 and depicted in the drawings. The example includes horizontal tubing on diamond for securing the platform to a wall, a stair case, a guard rail system and accessory web bracket and other framing for bagger, scale and conveyor accessories.

| Order | Type | Spacing |
|---|---|---|
| 1 | Standard Web Bracket | 0 inches |
| 2 | Standard Web Bracket | 18 inches |
| 3 | Accessory Web Bracket | 20-⅛ inches |
| 4 | Accessory Web Bracket | 23-½ inches |
| 5 | Standard Web Bracket | 18-⅝ inches |
| 6 | Standard Web Bracket | 24 inches |
| 7 | Standard Web Bracket | 24 inches |
| 8 | Standard Web Bracket | 24 inches |
| 9 | Standard Web Bracket | 35-¾ inches |
| 10 | Standard Web Bracket | 24 inches |
| 11 | Standard Web Bracket | 24 inches |
| 12 | Standard Web Bracket | 24 inches |
| 13 | Accessory Web Bracket | 18-⅝ inches |
| 14 | Accessory Web Bracket | 23-½ inches |
| 15 | Standard Web Bracket | 20-⅛ inches |
| 16 | Standard Web Bracket | 18 inches |

Example 4

This example presents the spacing of Vertical Legs in a sanitary platform system according to the present invention of Examples 1, 2 and 3 and depicted in the drawings. The example includes horizontal tubing on diamond for securing the platform to a wall, a stair case, a guard rail system and accessory web bracket and other framing for bagger, scale and conveyor accessories.

| Order | Spacing |
|---|---|
| 1 | 0 inches |
| 2 | 98-⅞ inches |
| 3 | 100 inches |
| 4 | 98-⅞ inches |

Although the present invention has been described in considerable detail with reference to certain preferred versions thereof, other versions are possible with substituted, varied and/or modified materials and steps are employed. These other versions do not depart from the invention. Therefore, the spirit and scope of the appended claims should not be limited to the description of the preferred versions contained herein.

What is claimed is:

1. A sanitary platform system with one or more deck plates above a ground surface comprised of:

a. two or more main rails having length that are on diamond and are side-by-side with a space between the main rails;

b. one or more web brackets mounted in spaced-apart relation along the length of each of the main rails, wherein each web bracket comprises a plate having an interior area and a peripheral edge, two or more tabs spaced apart along the peripheral edge, wherein the tabs are configured so that the tabs buttress against one of the deck plates; and a perimeter defining an opening for receiving one of the main rails;

c. two or more vertical legs supporting each of the main rails above the ground surface; and d. one or more deck plates welded to the tabs of the web brackets.

2. The sanitary platform system of claim 1 with one or more accessory web brackets mounted on a main rail.

3. The sanitary platform system of claim 1 with one or more cross connecting tubes on diamond with each cross connecting tube connecting two vertical legs and one or more stiffener plates that each mate against a vertical leg and a cross connecting tube with no dead corners.

4. The sanitary platform system of claim 1 where vertical legs which support the main rails above the ground surface have a bottom and top with the bottom resting on the ground surface and the top has a "V"-shaped saddle for receiving in supporting relation a main rail on diamond.

5. The sanitary platform system of claim 1 with an accessory cross tube on diamond that is attached between side-by-side main rails through accessory cross tube mounting brackets and one or more accessory mounting pads positioned on the accessory cross tube on diamond.

6. The sanitary platform system of claim 1 with two or more vertical posts appending superior relative to the deck plates that terminate in a solid surface on an angle and one or more horizontal guard rails on diamond running between the vertical posts.

7. A sanitary platform system with one or more deck plates above a ground surface comprised of:

a. two or more main rails having length that are on diamond and are side-by-side with a space between the main rails;

b. a plurality of standard web brackets mounted in spaced-apart relation along the length of each of the main rails, wherein each web bracket comprises a plate having an interior area and a peripheral edge, two or more tabs spaced apart along the peripheral edge, wherein the tabs are configured so that the tabs buttress against one of the deck plates; and a perimeter defining an opening for receiving one of the main rails;

c. a plurality of vertical legs which support the main rails above the ground surface having a bottom and top with the bottom resting on the ground surface and the top having a shaped saddle for receiving in supporting relation a main rail on diamond;

d. a plurality of cross connecting tubes on diamond with each cross connecting tube connecting two vertical legs and one or more stiffener plates that each mate against a vertical leg and a cross connecting tube with no dead corners;

e. a plurality of deck plates welded to the tabs of the web brackets forming a mezzanine with a perimeter; and f. a guard rail system substantially surrounding the perimeter of the mezzanine comprised of plurality of vertical posts appending superior relative to the deck plates that terminate in a solid surface on an angle and a plurality of horizontal guard rails on diamond running between the vertical posts.

8. The sanitary platform system of claim 7 with one or more accessory web brackets mounted on a main rail.

9. The sanitary platform system of claim 7 with an accessory cross tube on diamond that is attached between side-by-side main rails through accessory cross tube mounting brackets and one or more accessory mounting pads positioned on the accessory cross tube on diamond.

10. The sanitary platform system of claim 9 with an accessory cross tube on diamond that is attached between side-by-side main rails through accessory cross tube mounting brackets and one or more accessory mounting pads positioned on the accessory cross tube on diamond.

* * * * *